US010605247B2

(12) United States Patent
Yeh

(10) Patent No.: US 10,605,247 B2
(45) Date of Patent: Mar. 31, 2020

(54) AXLELESS FAN DEVICE

(71) Applicant: Hsiu Hui Yeh, Taipei (TW)

(72) Inventor: Hsiu Hui Yeh, Taipei (TW)

( * ) Notice: Subject to any disclaimer, the term of this patent is extended or adjusted under 35 U.S.C. 154(b) by 156 days.

(21) Appl. No.: 15/682,566

(22) Filed: Aug. 22, 2017

(65) Prior Publication Data

US 2019/0063444 A1 Feb. 28, 2019

(51) Int. Cl.

| | |
|---|---|
| ***F04D 25/04*** | (2006.01) |
| ***F04D 29/32*** | (2006.01) |
| ***F04D 25/02*** | (2006.01) |
| ***F04D 19/00*** | (2006.01) |
| ***F04D 25/06*** | (2006.01) |
| ***F04D 29/058*** | (2006.01) |

(52) U.S. Cl.

CPC ..... *F04D 25/045* (2013.01); *F04D 19/002* (2013.01); *F04D 25/02* (2013.01); *F04D 25/026* (2013.01); *F04D 25/0606* (2013.01); *F04D 29/058* (2013.01); *F04D 29/326* (2013.01)

(58) Field of Classification Search

CPC ..... F04D 25/02; F04D 25/026; F04D 25/06; F04D 25/08; F04D 25/066; F04D 25/0606; F04D 25/166; F04D 25/045; F04D 29/38; F04D 29/526; F04D 29/326; F04D 29/325; F04D 29/542; F04D 29/522; F04D 19/002; F04D 3/005; F04D 19/007; F04D 13/12; F04D 25/068; F04D 29/34; F04D 29/663; F04D 29/584; F04D 29/263; F04D 25/0613; F04D 25/062; F04D 25/064; F04D 25/0653; F04D 29/181; F04D 29/186; F04D 29/20; F04D 29/329; F05D 2250/75; F05D 2240/61; H02K 7/14; H02K 16/02; F01P 5/02; F01P 1/06; F01P 2005/025

USPC ..... 416/124, 126; 415/60

See application file for complete search history.

(56) References Cited

U.S. PATENT DOCUMENTS 9,273,873 B1 * 3/2016 Ohunna, II ..... F04D 13/028
2017/0159663 A1 * 6/2017 Jang ..... F04D 25/08

FOREIGN PATENT DOCUMENTS

JP 2013189934 A * 9/2013

OTHER PUBLICATIONS

Advantages of Magnetic Bearings; (Year: 2014).*

* cited by examiner

*Primary Examiner* — Devon C Kramer
*Assistant Examiner* — Christopher J Brunjes

(57) ABSTRACT

An axleless blade set includes an annular frame and a driving structure. The driving structure serves to drive the annular frame. Blades extend from an inner wall of the annular frame and an outer wall of the annular frame is formed with a plurality of driving sheets. The driving structure serves to drive the driving sheets so as to drive the annular frame and the blades therein to rotate. As a result, wind blows from one side to another side along an axial direction with a large strength. Therefore defects of wind blowing from prior art fans of low strength and dispersing randomly are resolved.

2 Claims, 7 Drawing Sheets

AXLELESS FAN DEVICE

FIELD OF THE INVENTION

The present invention is related to fans, and in particular to an axleless fan device.

BACKGROUND OF THE INVENTION

The conventional fan mainly includes a plurality of blades along a rotary shaft. The plurality of blades extend from the rotary shaft. When a driving device at a rear side of the rotary shaft drives the rotary shaft to rotate, the blades are driven to rotate and thus air are driven to flow along a predetermined direction.

However, in the prior art fan structure, the blades are arranged around the rotary shaft. When the blades rotate, the wind becomes smaller and smaller along radial inward directions. Therefore the wind disperses outwards and thus, the wind cannot be concentrated. As a result, the wind strength is insufficient.

SUMMARY OF THE INVENTION

Accordingly, the object of the present invention is to provide an axleless fan device, wherein wind blows from one side to another side along an axial direction with a large strength. Therefore defects in the prior art of low wind strength and without concentrating along the axial direction are resolved.

To achieve above object, the present invention provides an axleless fan device, comprising: an axleless blade set including an annular frame and a plurality of blades; the plurality of blades being connected to an inner wall of the annular frame; each blade extending inwards from the inner wall of the annular frame toward a center of the annular frame; an outer wall of the annular frame being formed with a plurality of driving sheets which are arranged along radial directions of the annular frame; and a driving structure for driving the driving sheets to rotate so as to drive the annular frame to rotate; as a result, the blades within the annular frame rotating therewith so as to generate an air beam to flow from one side of the annular frame to another side of the annular frame.

DETAILED DESCRIPTION OF THE INVENTION

Figure 1:
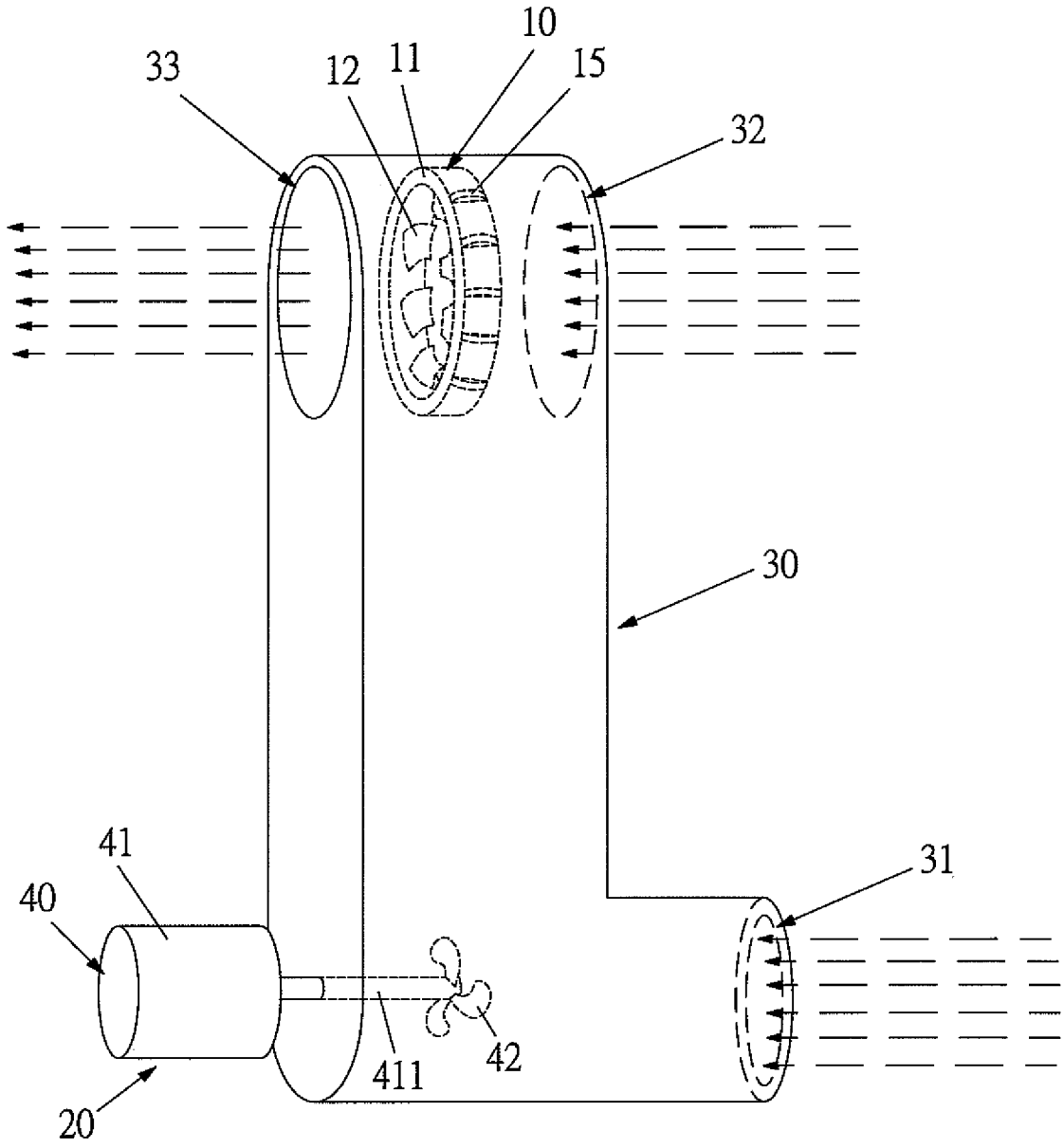
FIG. 1 is a perspective view of the first embodiment of the present invention.
Figure 2:
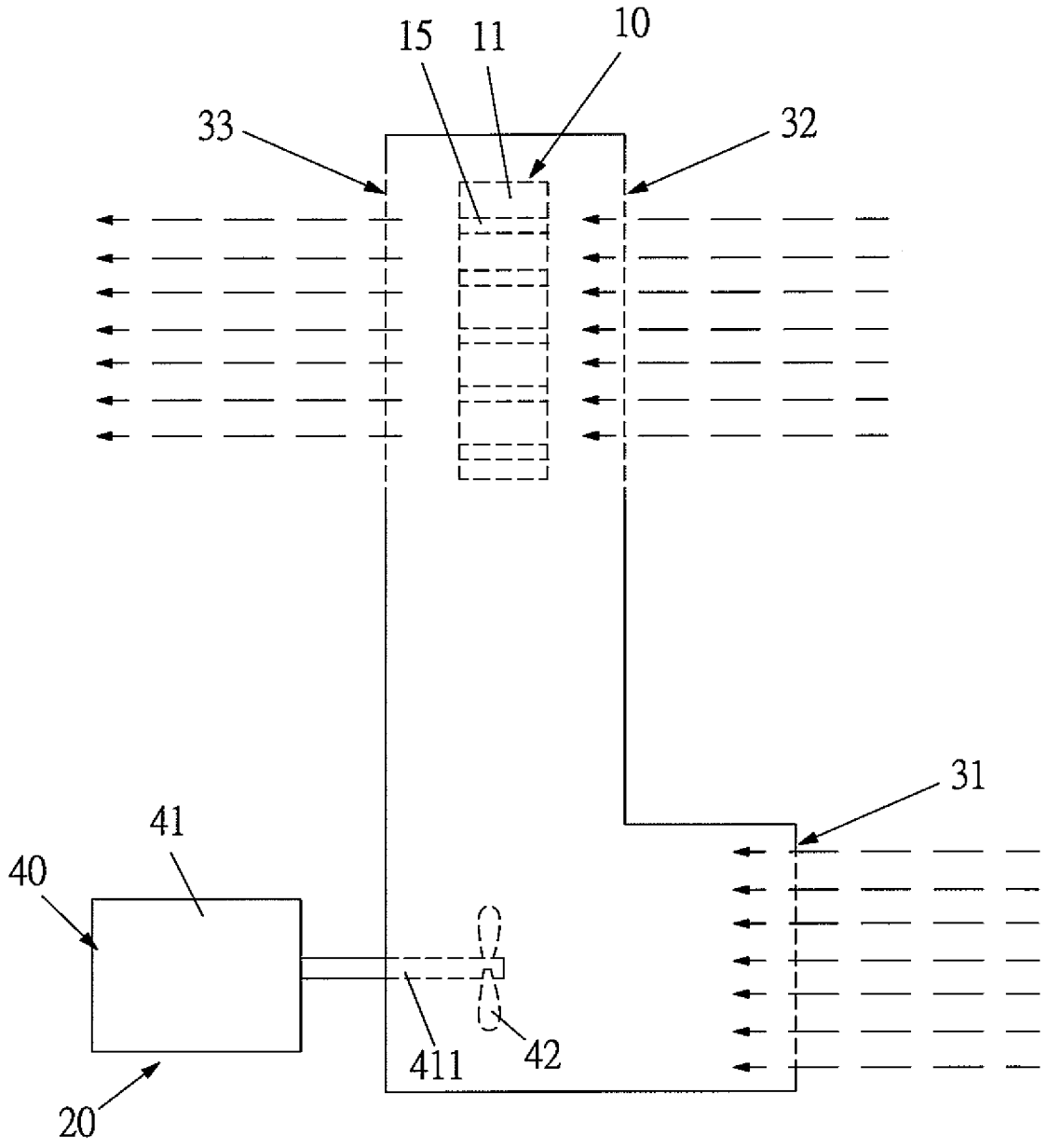
FIG. 2 is a lateral schematic view of the second embodiment of the present invention.
Figure 3:
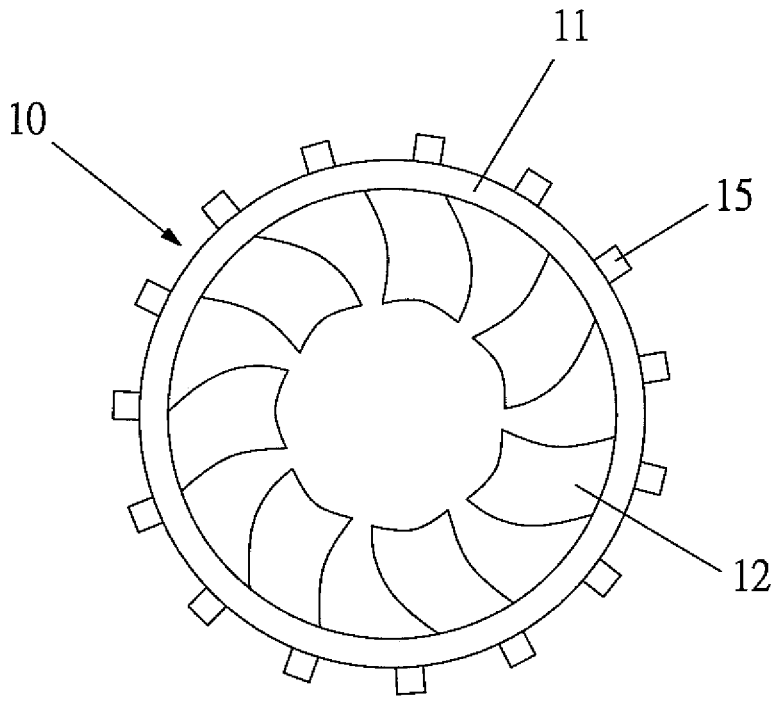
FIG. 3 is a plane schematic view of the axleless blade set of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

An axleless blade set 10 includes an annular frame 11 and a plurality of blades 12. The plurality of blades 12 are connected to an inner wall of the annular frame 11. Each blade 12 extends inwards from the inner wall of the annular frame 11 toward a center of the annular frame 11. An outer wall of the annular frame 11 is formed with a plurality of driving sheets 15 which are arranged along radial directions of the annular frame 11.

When wind blows toward the axleless blade set 10 along a direction vertical to an axial direction of the annular frame 11, the plurality of driving sheets 15 are driven to rotate so as to drive the annular frame 11 to rotate therewith. Then, the plurality of blades 12 within the annular frame 11 will rotate therewith. As a result, the wind blows from one side of the annular frame 11 to another side thereof so as to form with a wind beam.

A driving structure 20 serves to drive the driving sheets 15 to rotate so as to drive the annular frame 11 to rotate. As a result, the blades 12 within the annular frame 11 rotate therewith so as to generate an air beam to flow from one side of the annular frame 11 to another side of the annular frame 11. In this embodiment, the plurality of blades 12 are extended from the inner wall of the annular frame 11 toward the center of the annular frame 11. Therefore the wind will concentrates and flow along an axial direction of the annular frame 11.

A guide casing 30 has a tubal structure and includes a lower inlet 31, an upper inlet 32 and an upper outlet 33. The axleless blade set 10 is rotatably installed within the guide casing 30 near the upper outlet 33.

The driving structure 20 includes a motor and fan set 40 which is installed within the guide casing 30 and near the lower inlet 31. The motor and fan set 40 includes a motor 41, a spindle 411 extending outwards from the motor 441 and a plurality of fans 42 engaging to the spindle 411. However, installing of the motor and blades is well known in the art and thus the structure shown in the drawing is not used to confine the scope of the present invention. Other structure which causes fans are driven by a motor is usable in the present invention. By the motor and fan set 40, air flows into the guide casing 30 from the lower inlet 41 and then flows out from the upper outlet 32 of the guide casing 30.

The air will driven the annular frame 11 to rotate so that the driving sheets 15 at outer side of the annular frame 11 will rotate. As a result, wind flowing into the upper inlet 32 will blow out from the upper outlet 33.

Figure 4:
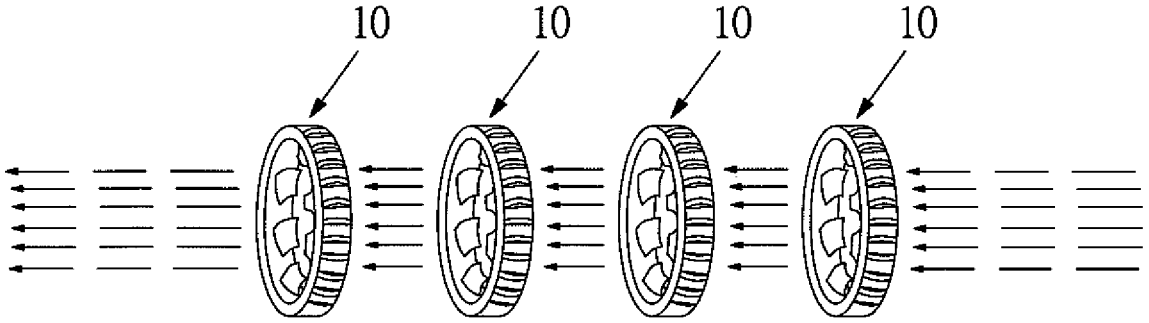
FIG. 4 is a schematic view showing the second embodiment of the present invention.

FIG. 4 shows the second embodiment of the present invention, in this embodiment, a plurality of axleless blade sets 10 are connected serially one by one along an axial direction of the axleless blade set 10. The former blade set 10 will drive next blade set 10. The air will be accelerated. Therefore the wind flowing out from the blade sets 10 is enhanced.

Above mentioned serial connection of axleless blade sets 10 may be used to drive a jet engine. The wind flowing out of the axleless blade sets 20 are very strong so as to drive air around the jet engine to cause that the air also flows into the engine to generate a great explosion. However, since the wind is concentrated in the axial direction. Therefore, the requirement of metal strength in forging is lower than the prior art. Thus the overall efficiency is promoted and the cost is down.

Figure 5:
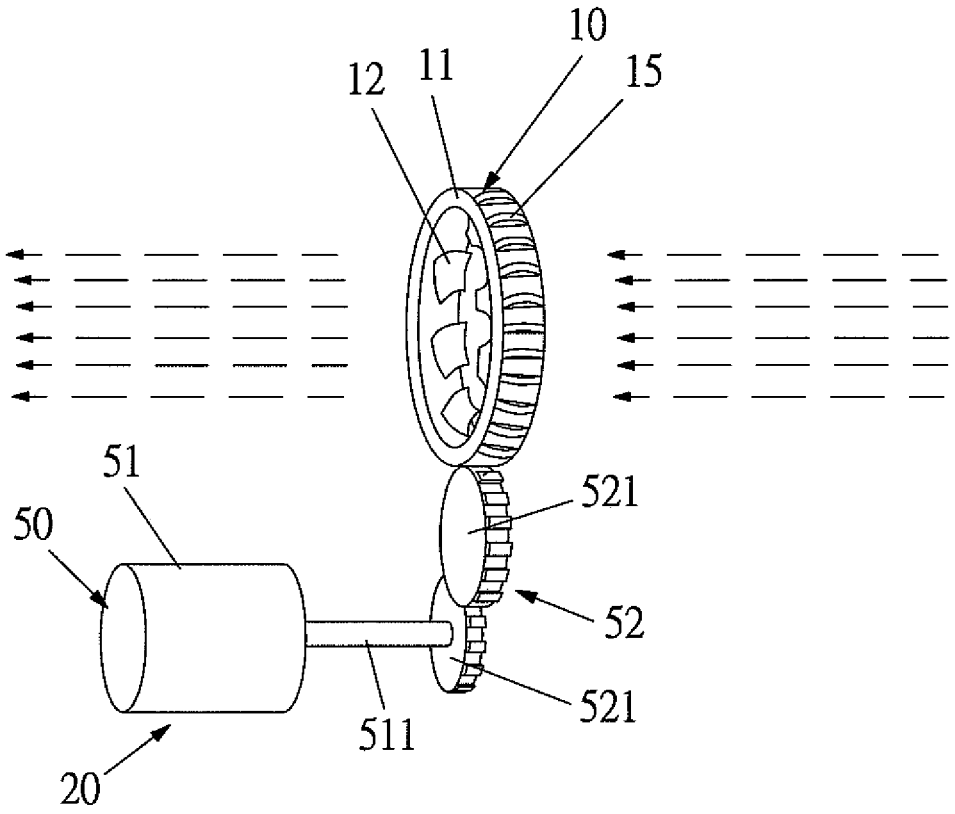
FIG. 5 is a schematic view of the third embodiment of the present invention.
Figure 6:
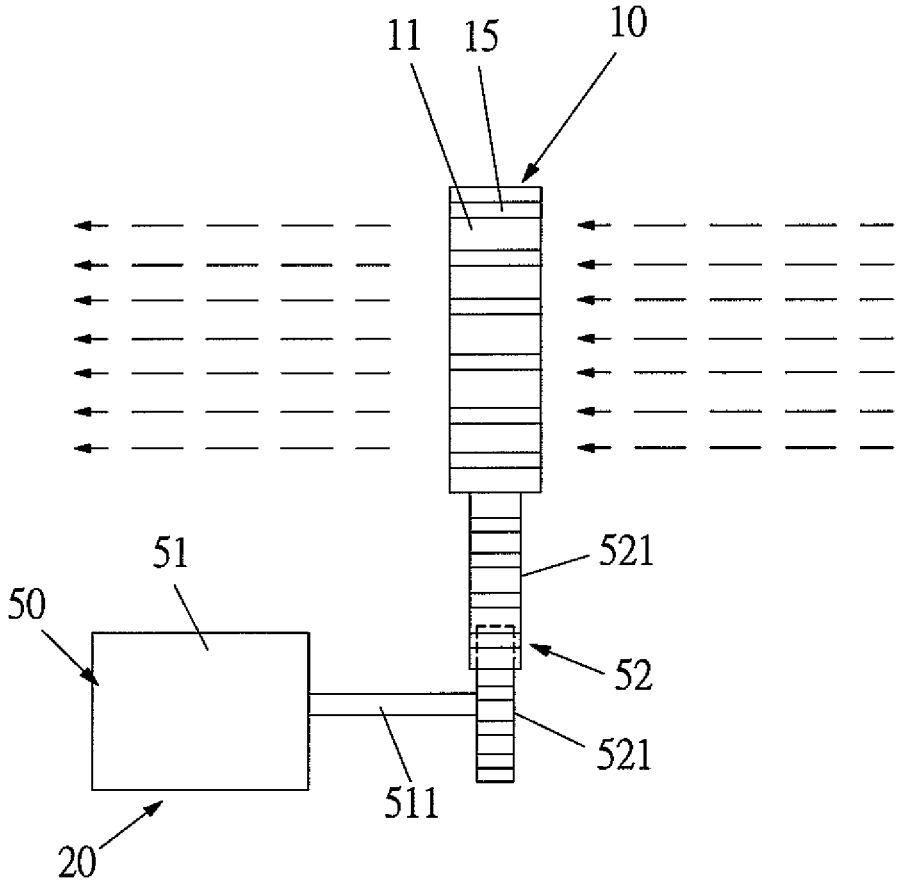
FIG. 6 is a lateral schematic view of the third embodiment of the present invention.

FIGS. 5 and 6 shows the third embodiment of the present invention. It shows that the different driving ways for the motor used in the present invention. This embodiment includes the following elements.

An axleless blade set 10 includes an annular frame 11 and a plurality of blades extending form an inner wall of the annular frame 11 to a center of the annular frame 11. An outer wall of the annular frame 11 extends with a plurality of driving sheets 15.

A driving structure 20 serves for driving the plurality of driving sheets 15 so as to drive the annular frame 11 to rotate and thus the plurality of blades within the annular frame 11 rotates therewith. Therefore wind beam flows from one side of the annular frame 11 to another side. Since the blades 12 extended from the inner wall of the annular frame 11 toward the center thereof, the wind beam will concentrate along a central axial direction. Therefore wind force is concentrated.

The driving structure 20 includes a motor and gear set 50. The motor and gear set 50 includes a motor 51 and a gear set 52 which is coupled to a spindle 511 of the motor 51. The gear set 52 includes at least one gear 521. It is shown in the drawing that the gear set 52 is connected to the spindle 511 of the motor 51. The driving sheets 15 are equally spaced arranged on the outer wall of the annular frame 11 so that these driving sheets 15 can be engaged to the gear set. When the motor 51 drives the gear set 52 to rotate, the plurality of driving sheets 15 are also driven. And thus the annular frame 11 and the blades 12 therein are driven to rotate. Thus wind flows from one side of the annular frame 11 to another side.

Figure 7:
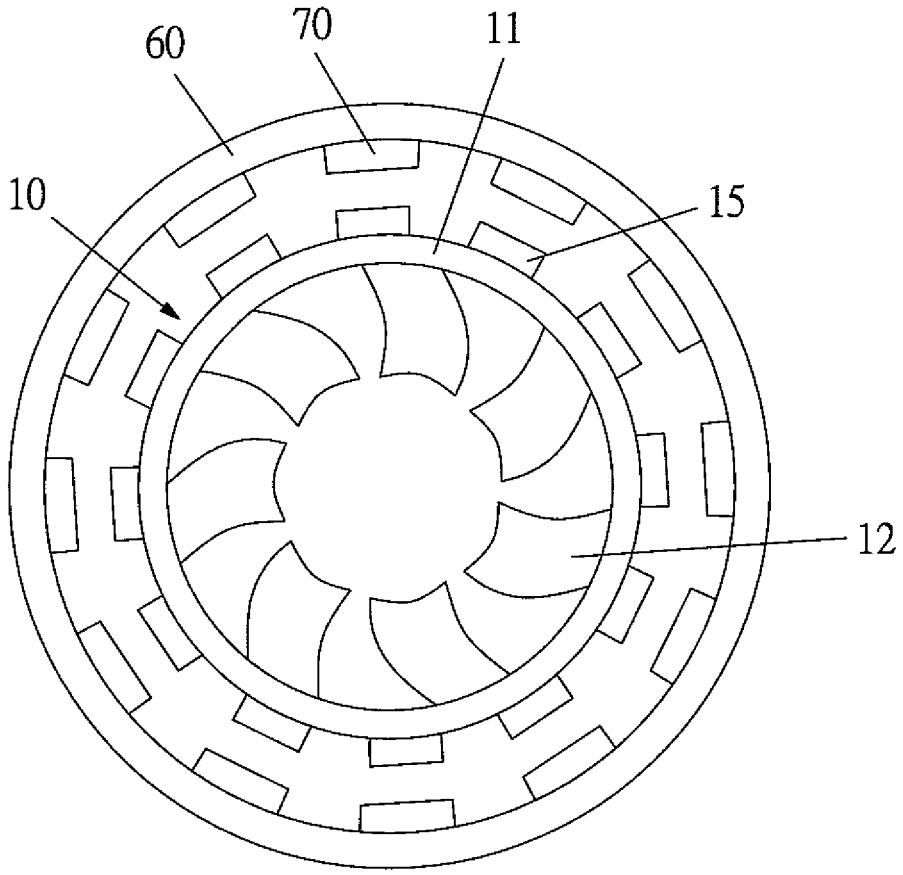
FIG. 7 is a cross sectional view of the fourth embodiment of the present invention.

FIG. 7 shows a fourth embodiment of the present invention, another way for driving is shown. However, the elements having identical functions as described above are illustrated with the same numerals.

In the embodiment shown in FIG. 7, the driving sheets 15 are magnetic. The driving structure 20 is a magnetic track ring 60. A plurality of magnetic sheets 70 are extended from an inner wall of the magnetic track ring 60. When the driving sheets 15 or the magnetic sheets 70 are conducted, the annular frame 11 is driven to rotate and thus the blades 12 rotate so as to drive air to flow from one side to another side along an axial direction with a larger strength.

Advantages of the present invention are that the blades extend from an inner wall of the annular frame and an outer wall of the annular frame is formed with a plurality of driving sheets. A driving structure serves to drive the driving sheets so as to drive the annular frame and the blades therein to rotate. As a result, wind blows from one side to another side along an axial direction with a large strength. Therefore defects in the prior art of low wind strength and without concentrating along the axial direction are resolved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An axleless fan device, comprising:

an axleless blade set including an annular frame and a plurality of blades; the plurality of blades extending inwards from an inner wall of the annular frame toward a center thereof; an outer wall of the annular frame being formed with a plurality of driving sheets which are arranged along radial directions of the annular frame;

a guide casing having a tubal structure and including a lower inlet, an upper inlet and an upper outlet; the axleless blade set being rotatably installed within the guide casing; and a driving structure, the driving structure comprising a motor and a fan:, the fan is installed at a lower side of the guide casing and is driven by the motor; the driving structure generates an air flow into the guide casing from the lower inlet which imparts a driving force onto the driving sheets so as to cause the annular frame to rotate; as a result, the blades within the annular frame are rotating therewith so as to generate an air beam to flow from one side of the annular frame to another side thereof; wherein the air beam flows along an axial direction of the annular frame; and as a result, wind flowing into the upper inlet will blow out the upper outlet.

2. The axleless fan device as claimed in claim 1, further comprising:

at least one another axleless blade set; wherein all the axleless blade sets are arranged along an axial direction.

* * * * *